US005181643A

United States Patent [19]

Radtke

[11] Patent Number: 5,181,643

[45] Date of Patent: Jan. 26, 1993

[54] SHEET-STAPLING DEVICE

[75] Inventor: Manfred Radtke, Korb, Fed. Rep. of Germany

[73] Assignee: Eastman Kodak Company, Rochester, N.Y.

[21] Appl. No.: 779,771

[22] Filed: Oct. 21, 1991

[30] Foreign Application Priority Data

Nov. 10, 1990 [DE] Fed. Rep. of Germany ..... 4035869

[51] Int. Cl.[5] ..... B27F 7/30

[52] U.S. Cl. ..... 227/110; 227/129; 227/131

[58] Field of Search ..... 227/78, 81, 110, 111, 227/131, 129, 123

[56] References Cited

U.S. PATENT DOCUMENTS 3,514,027 5/1970 Linden ..... 227/81
4,204,627 5/1980 Kutzner et al. ..... 227/81
4,726,505 2/1988 Okazaki ..... 227/131 X
4,913,332 4/1990 Olesen ..... 227/131 X
5,029,745 7/1991 Akizawa et al. ..... 227/131 X
5,076,483 12/1991 Olesen ..... 227/131

*Primary Examiner*—Douglas D. Watts
*Assistant Examiner*—Rinaldi Rada
*Attorney, Agent, or Firm*—Lawrence P. Kessler

[57] ABSTRACT

A stapling device comprises a stapling head (1) and a driving element (2) for actuating said stapling head, which are connected by a releasable coupling (6). The stapling head (1) and the driving element (2) are shiftably mounted on housing portions (13, 14) which are connected with each other, and the stapling head (1) is guided in grooves (13*a*, 14*a*) which are open toward the stapling position so that the stapling head (1) can be removed from the housing portions (13, 14) when the driving element (2) has been disengaged.

4 Claims, 2 Drawing Sheets

FIG. 2
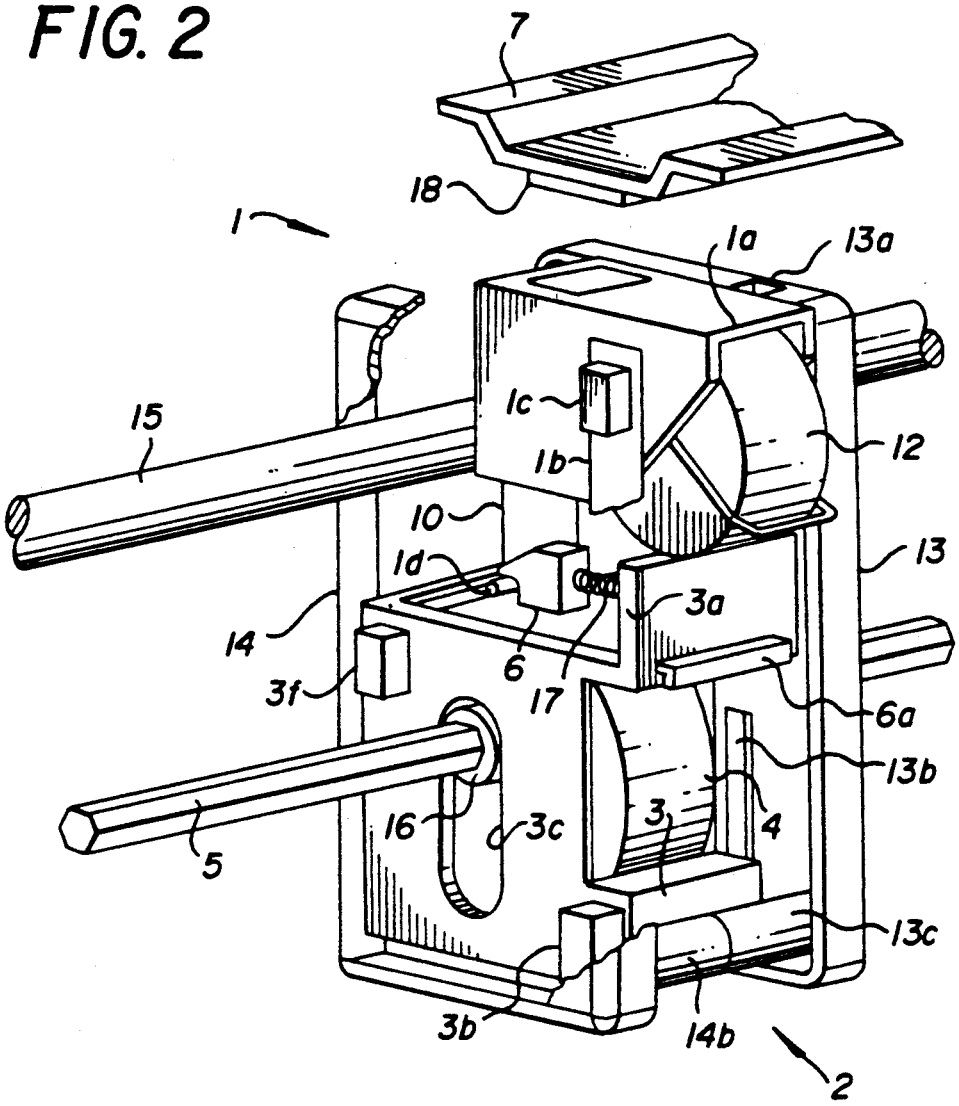
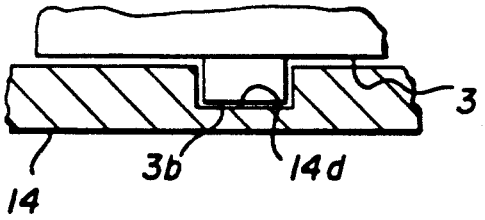
FIG. 3
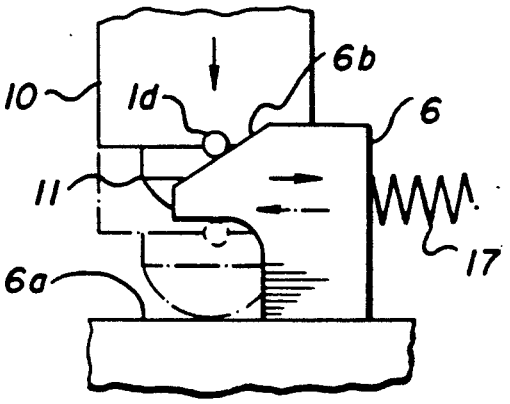
FIG. 4

SHEET-STAPLING DEVICE

BACKGROUND OF THE INVENTION

The invention relates in general to a stapling device for connecting sheets arranged in a stack by staples and, more particularly, to a stapling device comprising a driving element and a stapling head, which can be actuated by said driving element and is movable into contact with an anvil and being adjustable to a plurality of selectable stapling positions.

By a publication in *Research Disclosure Bulletin*, Item No. 15 710 of May 1977, a stapling device of a finishing unit of a copier has been disclosed which is guided on guide rods and can be adjusted to a plurality of selectable stapling positions. If the stapling head does not function properly, for example because a deformed staple has jammed, the device has to be disassembled in a time-consuming manner in order to repair the stapling device outside the unit.

In order to eliminate jamming, it is also known for part of the stapling head of a desktop stapling device to be designed as a pivotable element. However, in the case of such a device, the cause of the jamming typically cannot be determined because the corresponding functional elements are hidden and are not visible from outside. If functional elements are damaged, therefore, jamming may recur, and attempts at eliminating the damage will fail so that the stapling device becomes unusable.

In the case of both of these known stapling devices, repeated jamming in the stapling head results in long close-down periods of the stapling device. In particular, if the stapling device is held in engagement with driving and guide means which allow adjustment to a plurality of stapling positions, exchanging or repairing a defective stapling device takes a lot of time during which the stapling device is out of use.

SUMMARY OF THE INVENTION

This invention is directed to a device of the generic type such that the stapling head can be exchanged rapidly and without difficulty in the case of malfunctioning. According to the invention, the desired result is attained in that the stapling head and the driving element are connected by a releasable coupling. According to an advantageous modification of the invention, the stapling head and the driving element are shiftable on a common housing, with the stapling head being guided in a guide groove open toward the anvil so that it can be removed. According to a preferred modification of the invention, the coupling is designed as a coupling slider which is guided under spring load on the driving element and is held in positive engagement with the entrainment members of the stapling head. According to a particularly advantageous modification of the invention, the stapling device is shiftably guided on a guide rod so as to be adjustable to various stapling positions, and the driving element is engaged by a polygonal driving shaft connected positively therewith. Advantageously the stapling head includes all functional parts required for transporting, separating, folding and driving in of wire sections formed into staples which are stored in the form of a wire strip in an exchangeable magazine.

Thanks to the design and association of stapling head and driving elements, according to the invention the stapling head can be simply and rapidly exchanged in the case of malfunctioning. When the defective stapling head has been removed, it can be examined from all sides outside the system and repaired, if necessary, while the stapling device can immediately continue operation with a freshly exchanged stapling head. The invention, and its objects and advantages, will become more apparent in the detailed description of the preferred embodiment presented below.

BRIEF DESCRIPTION OF THE DRAWINGS

Further features and advantages can be inferred from the description of an embodiment of the invention illustrated in the drawings in which:

FIG. 2 is an oblique view at a slightly smaller scale of the device according to FIG. 1 with the housing and the guide means, portions broken away to facilitate viewing;

FIG. 3 is a top plan view, on an enlarged scale, partly in cross-section, of a portion of the housing and guide means of FIG. 1; and FIG. 4 is a lateral view, on an enlarged scale, of a portion of the device the action for coupling the stapling head to the driving element.

DESCRIPTION OF THE PREFERRED EMBODIMENT

Figure 1:
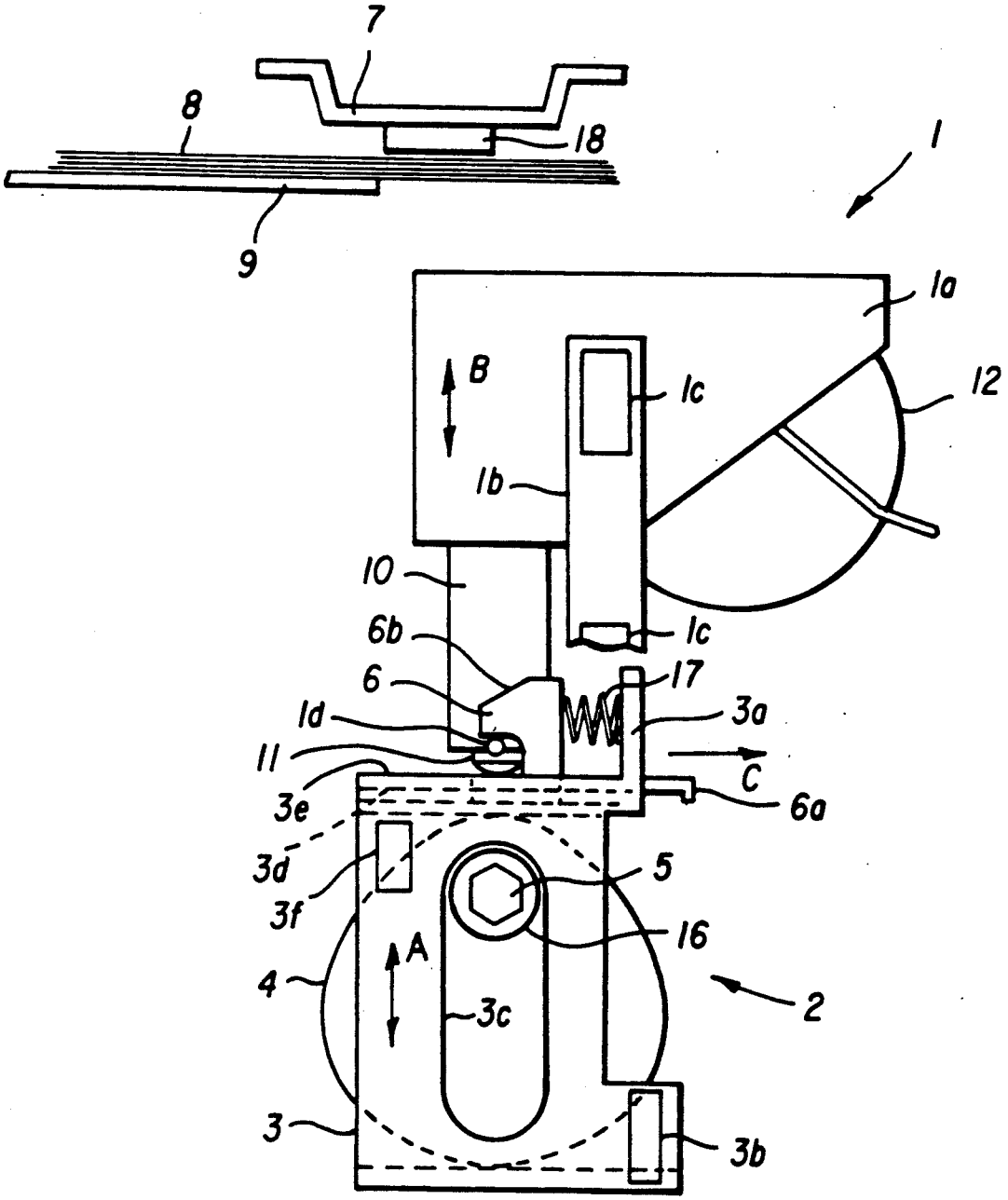
FIG. 1 is a lateral view of the device in its initial position, without the housing.

Referring now to the accompanying drawings, the stapling device according to the invention is arranged on a finishing unit of a type known per se and not illustrated, in which sheets fed individually, in particular copy sheets dispensed by a copier, are collected in a collecting station 9 and combined in sets by means of staples. The stapling device is mounted as a complete assembly unit in or on two cup-shaped plastic housing portions 13 and 14 which are connected by a plurality of support legs 13*c* and 14*b*, respectively, which are screwed together and held in positive engagement (only two support legs have reference numerals).

The stapling head 1 has a housing 1*a* in which a commercially available stapling head of a type known per se with an exchangeable magazine 12 is mounted, which comprises all functional elements required for transporting, separating, folding and driving in of wire sections formed into staples which are stored in the form of a wire strip in magazine 12. An actuating member 10 of stapling head 1 comprises a pressure bolt 11 which is engaged by the upper side 3*e* of a bracket 3 of a driving element generally denoted 2. The U-shaped bracket 3 surrounds and positively engages a cam 4 which is mounted for rotation on bearings 16 arranged on either side and positively connected with said cam. The bracket 3 is provided with openings 3*c* arranged on either side and receiving the bearings 16 which allow the bracket 3 to move in the direction of the arrow "A". The bearings 16, which extend beyond the bracket 3 on either side, are mounted for rotation in the housing portions 13 and 14, as can be seen from FIG. 2. The bracket 3 is guided on the housing portions 13 and 14 by guide webs 3*b* and 3*f*, which are arranged on either side and guided for movement in the direction of the arrow "A" in correspondingly disposed guide grooves 13*b* and 14*d* (of which only one is illustrated) in FIG. 3.

A coupling slider 6, which positively engages entrainment members 1*d* projecting from either side of the actuating member 10 of stapling head 1, is shiftably mounted on bracket 3. Coupling slider 6 is urged into the coupling position (illustrated in FIG. 2) by springs 17, which are supported on wall section 3*a* of bracket 3 and can be moved in the direction of the arrow "C" in opposition to springs 17 when a handle 6*a* is operated. Inclined portions 6*b* on coupling slider 6 allow the stapling head 1 to be automatically locked (illustrated in FIG. 4) during insertion in a manner to be described further below. The stapling head 1 is guided on the housing portions 13 and 14 by guide webs 1*c*, which are arranged on arms 1*b* molded on either side of housing 1*a* and, as shown in FIG. 2, engaging guide grooves 13*a*, 14*a*, which are open at the top (similar to the construction illustrated in FIG. 3).

The entire stapling device mounted on the housing portions 13, 14 is guided for shifting movement along a polygonal driving shaft 5 and a guide rod 15 and adjustable to several selectable stapling positions. The polygonal driving shaft 5 is rotated by a drive unit (not illustrated) and positively engages the correspondingly designed bearings 16. Since the stapling device is permanently held in positive engagement with the polygonal driving shaft 5, it is immediately ready to function in any of its stapling positions.

A collecting station 9 disposed above stapling head 1 accommodates the sheet stack 8 which is to be stapled. Above sheet stack 8 and opposite stapling head 1, an anvil plate 7 is arranged which, in a manner known per se, serves for folding over and clinching the staple ends projecting from the sheet stack 8. The stationary anvil plate 7 which comprises a plurality of anvils 18 of a type known per se, which are associated with the selectable stapling positions, is fixed in the position shown in FIGS. 1 and 2 by means of easily releasable attachment elements (not illustrated). In order that the stapling head 1 can be exchanged, the anvil plate 7 can be removed from the path of movement of the stapling head 1 (not illustrated) after release of the attachment elements.

The stapling device functions as follows.

In order to assume the desired stapling position, the stapling head 1 is shifted along the guide rod 15 and the polygonal driving shaft 5, either by a drive or manually, and is thus brought to the desired stapling position in which it is arrested (by a mechanism not illustrated). The stapling operation is started when the polygonal driving shaft 5 is rotated clockwise and the cam 4 is thus rotated out of its initial position illustrated in FIG. 1. During such movement, cam 4 moves bracket 3 upward in the direction of the arrow "A" (see FIG. 1). At the same time, the actuating member 10, which rests against the upper side 3*e* of bracket 3, is moved upward in the direction of the arrow "B". During such upward movement, the stapling head 1 approaches the sheet stack 8, placed in association with the anvil 18, to be stapled. During further movement of the actuating member 10, a wire section is separated in a manner known per se and not illustrated from the wire strip, folded to form a staple and driven into the sheet stack 8 from below. The staple ends projecting from the top of sheet stack 8 are folded over in a known manner on anvil 18 and clinched on the sheet stack 8.

Upon termination of the stapling operation, the entire stapling device 1, 2 is returned to its initial position shown in FIG. 1 by further clockwise rotation of the cam 4. Such rotation of the cam moves bracket 3 downward. At the same time, actuating member 10 is moved downward the coupling slider 6 through its engagement with entrainment members 1*d*. During such return movement, the wire strip is advanced in a known manner (not illustrated) so that a new stapling wire section is brought into its operative position.

If the mechanism of the stapling head 1 jams during stapling, the anvil plate 7 is removed while the drive is shut down and the coupling slider 6 then moved in a direction of the arrow "C" by the handle 6*a*, whereby the entrainment members 1*d* of the actuator 10 are released. With the coupling slider 6 extracted, stapling head 1 is lifted as a complete assembly unit in the direction "B" from the open guide grooves 13*a*, 14*a* of the housing portions 13, 14. Now one simple operation is enough to shift a new, properly functioning stapling head 1 in the reverse order into the housing 13, 14 with the entrainment members 1*d* urging the coupling slider 6 aside via the inclined portions 6*b* and in opposition to the force of spring 17 until they lock on the coupling slider 6 under the action of spring force (see FIG. 4). When the anvil plate 7 has been attached again, the stapling device is immediately ready for use.

The invention has been described in detail with particular reference to preferred embodiment thereof, but it will be understood that variations and modifications can be effected within the spirit and scope of the invention.

I claim:

1. Stapling device for connecting sheets arranged in a stack by means of staples, said device comprising:

a housing (13, 14); means for mounting said housing for movement to a plurality of selectable stapling positions; a driving element and a stapling head actuatable by said driving element located in said housing, said stapling head (1) including at least one entrainment member (1*d*) extending therefrom; means (6) for releasably coupling said stapling head (1) and said driving element (2) to enable said stapling head to be readily removed and replaced, said coupling means including a coupling slider (6) supported on said driving element (2), at least one spring for urging said coupling slider (6) for movement on said driving element (2) into engagement with said at least one entrainment member (1*d*); and means within said housing for guiding said coupled stapling head (1) and said driving element (2) for shifting movement in a direction to effect stapling, said coupling means (6) being movable transversely to such direction of shifting movement.

2. Stapling device according to claim 1 wherein said guide means includes webs (1*c*) arranged on said stapling head (1), and guide grooves (13*a*, 14*a*) defined in said housing (13, 14), open at one end, said guide grooves extending parallel to the direction of shifting movement of said driving element (2), said webs being respectively received in said guide grooves.

3. Stapling device according to claim 1 further including a polygonal driving shaft (5), said driving element (2) being held in positive and shiftable engagement with said polygonal driving shaft, and a guide rod (15), said housing (13, 14) being shiftably supported on said guide rod.

4. Stapling device according to claim 3 wherein said driving element (2) comprises a U-shaped bracket (3), and a cam (4) positively and shiftably mounted on said polygonal driving shaft (5), said cam positively engaging said U-shaped bracket (3).

* * * * *